US011020799B2

(12) United States Patent
Sato et al.

(10) Patent No.: US 11,020,799 B2
(45) Date of Patent: Jun. 1, 2021

(54) MARKING METHOD AND MARKING DEVICE FOR CASTING

(71) Applicant: SINTOKOGIO, LTD., Nagoya (JP)

(72) Inventors: Douta Sato, Toyokawa (JP); Takehiro Sugino, Toyokawa (JP)

(73) Assignee: SINTOKOGIO, LTD., Nagoya (JP)

( * ) Notice: Subject to any disclaimer, the term of this patent is extended or adjusted under 35 U.S.C. 154(b) by 152 days.

(21) Appl. No.: 16/427,511

(22) Filed: May 31, 2019

(65) Prior Publication Data

US 2019/0366428 A1 Dec. 5, 2019

(30) Foreign Application Priority Data

May 31, 2018 (JP) ..... JP2018-104162

(51) Int. Cl.
*B22D 45/00* (2006.01)
*B22D 46/00* (2006.01)

(52) U.S. Cl.
CPC ..... *B22D 45/00* (2013.01); *B22D 46/00* (2013.01)

(58) Field of Classification Search
CPC ..... B22D 45/00; B22D 46/00; B22D 31/00; B22D 31/002; B22D 17/2076; B22D 11/1233
See application file for complete search history.

(56) References Cited

U.S. PATENT DOCUMENTS 4,774,751 A * 10/1988 Pryor ..... B22D 46/00 29/407.04

FOREIGN PATENT DOCUMENTS

JP 2013-233572 A 11/2013

* cited by examiner

*Primary Examiner* — Kevin P Kerns
*Assistant Examiner* — Steven S Ha
(74) *Attorney, Agent, or Firm* — Oliff PLC

(57) ABSTRACT

[Problem] To provide a marking method and a marking device for a casting that are, even when foreign matter is adhered to a casting to be marked, capable of making an effective and appropriate mark on the casting.
[Solution] Detect foreign matter on an outer surface of a casting 100, set marking locations 118, 120-1, 120-2, and make a mark on the marking locations 118, 120-1, 120-2.

12 Claims, 6 Drawing Sheets

MARKING METHOD AND MARKING DEVICE FOR CASTING

TECHNICAL FIELD

The present invention pertains to a marking method and a marking device for a casting.

BACKGROUND

In casting production lines, a mark is made on castings obtained through the steps of mold molding, molten-metal pouring, and cooling, and an identification function is provided to each casting so as to enable traceability.

Conventionally, as a device that makes a mark on this type of casting, Patent Document 1 for example discloses a device that performs marking (hereinafter referred to as "marking device") by detecting the position of an end face of a bloom by means of image processing, and the document also discloses making markings (hereinafter referred to as "marks") after the position of the bloom is finely adjusted. Furthermore, the document indicates that in a step for conveying blooms, multiple blooms are gathered together by a gathering device, each bloom is positioned to a predetermined position, and then a mark is made.

The marking method for these blooms is a technique pertaining to the positioning of blooms and the marking device.

CITATION LIST

Patent Literature

Patent Document 1: JP 2013-233572 A

SUMMARY OF INVENTION

Technical Problem

The marking method disclosed in Patent Document 1 is capable of making a mark at an accurate position by means of positioning.

However, the marking location of a casting to be marked is not necessarily always in a state that is suitable for marking, and thus, it is not necessarily always possible to make appropriate marks.

In other words, foreign matter such as fins, remaining sand, and burn-ons can be present on the surface of a casting and a cast product obtained after a mold has been subjected to shake-out, and if the foreign matter is adhered to the marking location of a casting, this can result in not being able to make a mark.

It is not possible to predict the occurrence of the adherence of foreign matter described above, and it is difficult to take countermeasures in advance. In addition, due to the layout of casting production lines, the marking timing is before performing separation of castings and gates, etc., resulting in a situation in which it is difficult to make a mark after foreign matter has been removed.

Making a mark while foreign matter is still adhered to the casting will result in marking device damage and insufficient marking, meaning traceability would be lost, which has been a problem.

Thus, conventionally, as marking devices for castings, the reality is that devices that effectively and appropriately make a mark when foreign matter is adhered to the surface of a casting have not been provided.

The present invention was made in view of the circumstances indicated above, and addresses the problem of providing a marking method and a marking device for a casting that are, even when foreign matter is adhered to a casting to be marked, capable of making an effective and appropriate mark on the casting.

Solution to Problem

To solve the problem described above, the present invention employs the means described below. In other words, the present invention is a marking method for a casting that makes a mark on a casting, the marking method for a casting comprising: detecting foreign matter on an outer surface of the casting; and setting a marking location and making a mark on the marking location.

According to the present invention, even when foreign matter is adhered to a casting to be marked, it is possible to make an effective and appropriate mark on the casting.

One embodiment of the present invention comprises setting a standard marking location on the casting; setting an alternative marking location on the casting; detecting presence or absence of foreign matter for the standard marking location of the casting by comparing mold data of the casting with the casting; and making a mark on the standard marking location or the alternative marking location.

According to the present invention, even when foreign matter is present on a standard marking location, a mark is made on an alternative marking location, and thus, it is possible to prevent marking device damage and insufficient marking and make an effective and appropriate mark on a casting.

One embodiment of the present invention comprises making a mark on the alternative marking location when foreign matter is detected on the standard marking location.

According to the present invention, even when foreign matter is adhered to a casting to be marked, it is possible to make an effective and appropriate marking on the casting.

In one embodiment of the present invention, a cast product is configured so as to comprise one or more of the castings; and regarding the cast product, prior to machining, a mark on the alternative marking location is made as a temporary mark; and after the machining, a standard mark is made on the standard marking location of the casting on which the temporary mark was made.

In this one embodiment, a mark is made on each casting before castings and gates are separated, and thus, it is possible to secure traceability of each casting. In addition, by making a temporary mark (simple mark) on an alternative location, it is possible to efficiently make a mark with reduced working time.

In one embodiment of the present invention, a cast product is configured so as to comprise one or more of the castings; and regarding the cast product, prior to machining, a mark on the standard marking location and a mark on the alternative location are made as temporary marks; and after the machining, a standard mark is made on the standard marking location.

In this one embodiment, a mark is made on each casting before castings and gates are separated, and thus, it is possible to secure traceability of each casting. In addition, by making all of the marks temporary (simple marks) prior to machining, it is possible to efficiently make a mark with reduced working time. In addition, by making a standard mark after machining, a mark can be made on a clean surface free of foreign matter, which improves mark quality.

One embodiment of the present invention comprises inspecting for the foreign matter for each casting sequentially produced by casting equipment, and issuing a failure countermeasure signal of the casting equipment when a number of detections of the foreign matter exceeds a certain number of times or a certain ratio.

In this one embodiment, the number of detections of foreign matter can be imported into a casting process management database simultaneously with marking. Thus, a warning can be issued indicating that the number of foreign-matter detections is abnormal, and it is also possible to manage the casting process using the number of foreign-matter detections.

In addition, the present invention is a marking device for a casting that makes a mark on a casting by means of a marking mechanism, the marking device for a casting comprising: a foreign-matter detecting device that detects foreign matter on an outer surface of a casting by comparing mold data of a casting with a casting that was actually produced; and a marking control device that controls the marking mechanism so as to make a mark on a standard marking location that was set in the mold data, or set an alternative marking location and make a mark on the alternative marking location.

According to the present invention, even when foreign matter is present on a standard marking location, a mark is made on an alternative marking location, and thus, a marking device capable of preventing marking device damage and insufficient marking and making an effective and appropriate mark on a casting is provided.

Advantageous Effects of Invention

According to the present invention, even when foreign matter is adhered to a casting to be marked, it is possible to make an effective and appropriate mark on the casting.

DESCRIPTION OF EMBODIMENTS

An embodiment of the present invention is described in detail below with reference to the drawings.

Figure 1:
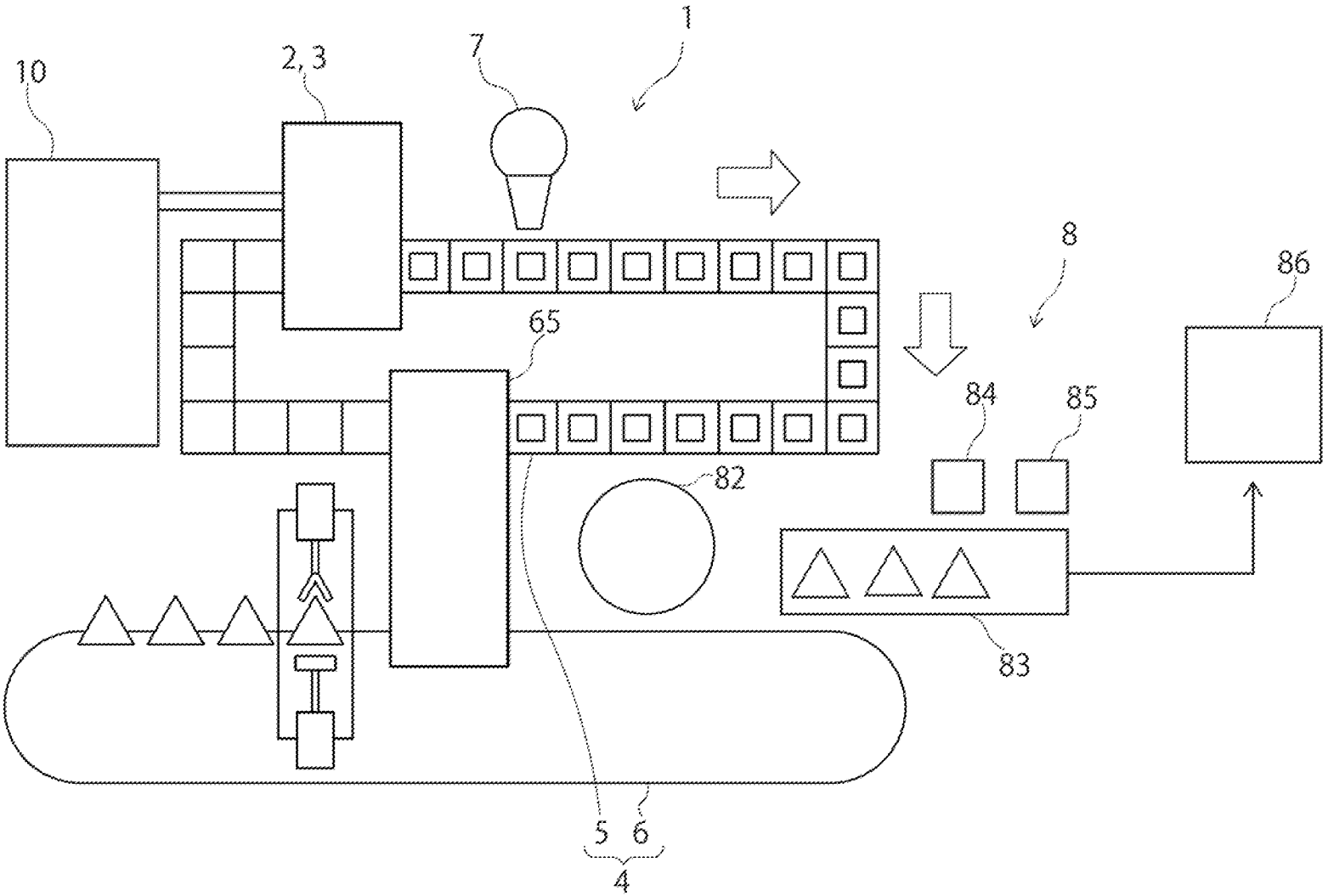
FIG. 1 is a schematic plan view of casting equipment comprising a marking device, which is one embodiment of the present invention.

FIG. 1 is a schematic plan view of casting equipment 1 comprising a marking device, which is one embodiment of the present invention.

In the casting equipment 1, a plurality of steps are performed when casting a casting, including molding, core installation, cooling/conveying, pouring, after-treatment, and sand processing. Corresponding to these steps, the casting equipment 1 comprises molding equipment 2, core installation equipment 3, cooling/conveying equipment 4, molten-metal pouring equipment 7, after-treatment equipment 8, and sand processing equipment 10.

The molding equipment 2 molds a mold from molding sand processed by the sand processing equipment 10. The core installation equipment 3 installs a core inside the mold. The molten-metal pouring equipment 7 produces molten metal and pours the molten metal into the mold. The cooling/conveying equipment 4 conveys the mold that was molded in the molding equipment 2 to the molten-metal pouring equipment 7. The cooling/conveying equipment 4 also conveys the mold in which molten metal has been cast in the molten-metal pouring equipment 7 while cooling the mold, subjects the mold to shake-out to take out the cast product, and then further conveys the cast product that was taken out to the after-treatment equipment 8 while cooling the cast product. The after-treatment equipment 8 performs after-treatment such as marking a casting and separation of a casting and gate. The sand processing equipment 10 processes molding sand used for mold molding.

The cooling/conveying equipment 4 comprises a primary cooling/conveying device 5, a secondary cooling/conveying device 6, and a mold shake-out device 65. The primary cooling/conveying device 5 receives the mold that was molded by the molding equipment 2, conveys the mold to the molten-metal pouring equipment 7, cools the mold into which molten metal was poured by the molten-metal pouring equipment 7, and conveys a cast product obtained after the mold was subjected to shake-out by the mold shake-out device 65 to the secondary cooling/conveying device 6.

The secondary cooling/conveying device 6 conveys the cast product obtained after the mold was subjected to shake-out to the after-treatment equipment 8. The after-treatment equipment 8 comprises a shot-blasting device 82, a conveyor 83, a marking device 84, and a casting-gate separation device 85. In the after-treatment equipment 8, the shot-blasting device 82 performs a shot-blasting treatment for the cast product that was conveyed from the secondary cooling device 6. Then, the cast product is conveyed to the marking device 84 by the conveyor 83.

The marking device 84 makes a predetermined mark on a casting, as described later in more detail, and the casting-gate separation device 85 performs separation of a casting and gate. After separation of a casting and gate, the casting is carried to machining equipment 86 present at a separate site, the necessary areas of the casting are subjected to machining such as foreign matter removal, cutting, grinding, and polishing, and then a product is obtained.

Figure 2:
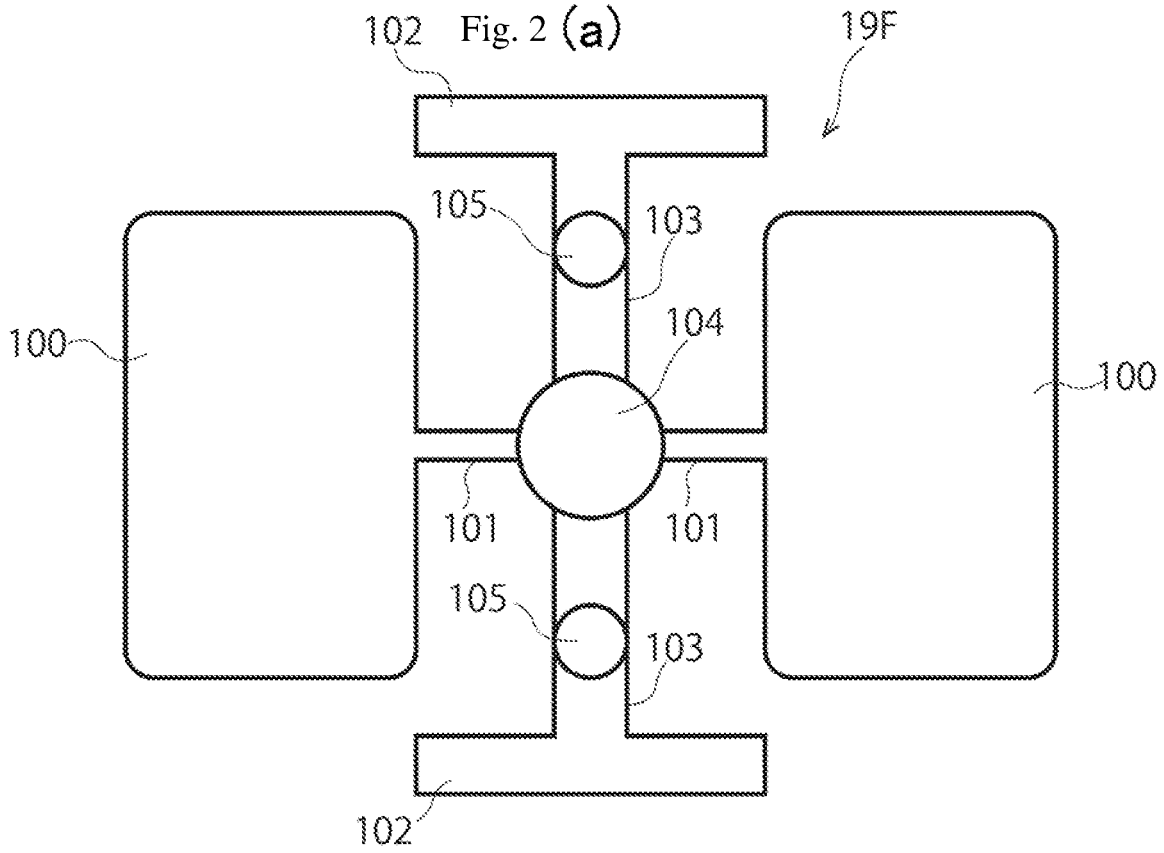
FIGS. 2(*a*) and 2(*b*) illustrates castings to be marked by the marking device, FIG. 2(*a*) being a plan view and FIG. 2(*b*) being a front view.
Figure 2:
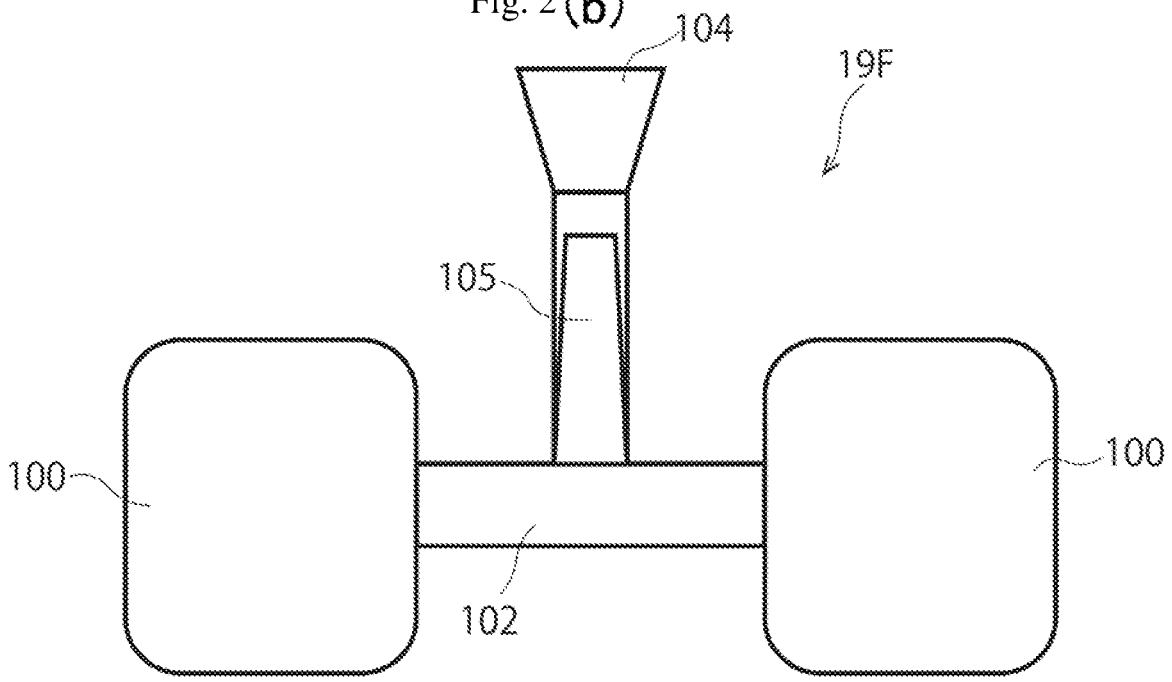

FIGS. 2(*a*) and 2(*b*) illustrate a cast product 19F to be conveyed to the marking device 84, (a) being a plan view and (b) being a front view.

The cast product 19F comprises: two castings 100, 100 that ultimately become a product; coupling portions 101, 101 (gates) that couple the castings 100, 100; hanger portions 102, 102; coupling portions 103, 103 (runners) that couple the hanger portions 102, 102 and are integrally connected to the coupling portions 101, 101; a pouring portion 104 (sprue) connected to the connection of the coupling portions 101, 101 and 103, 103; and projections 105, 105 provided to the coupling portions 103, 103.

The coupling portions 101, 101 are parts for allowing molten metal to reach the castings 100, 100 through the pouring portion 104.

When for example subjecting the mold to shake-out for the cast product 19F and conveying the cast product 19F, this cast product 19F is suspended by means of a hanger hook (not shown). The hanger portions 102, 102 are locking portions for suspending the cast product 19F by means of the hanger hook.

The projections 105, 105 are parts that are gripped by a robot (not shown) when the cast product 19F is transferred by the robot between steps.

Figure 3:
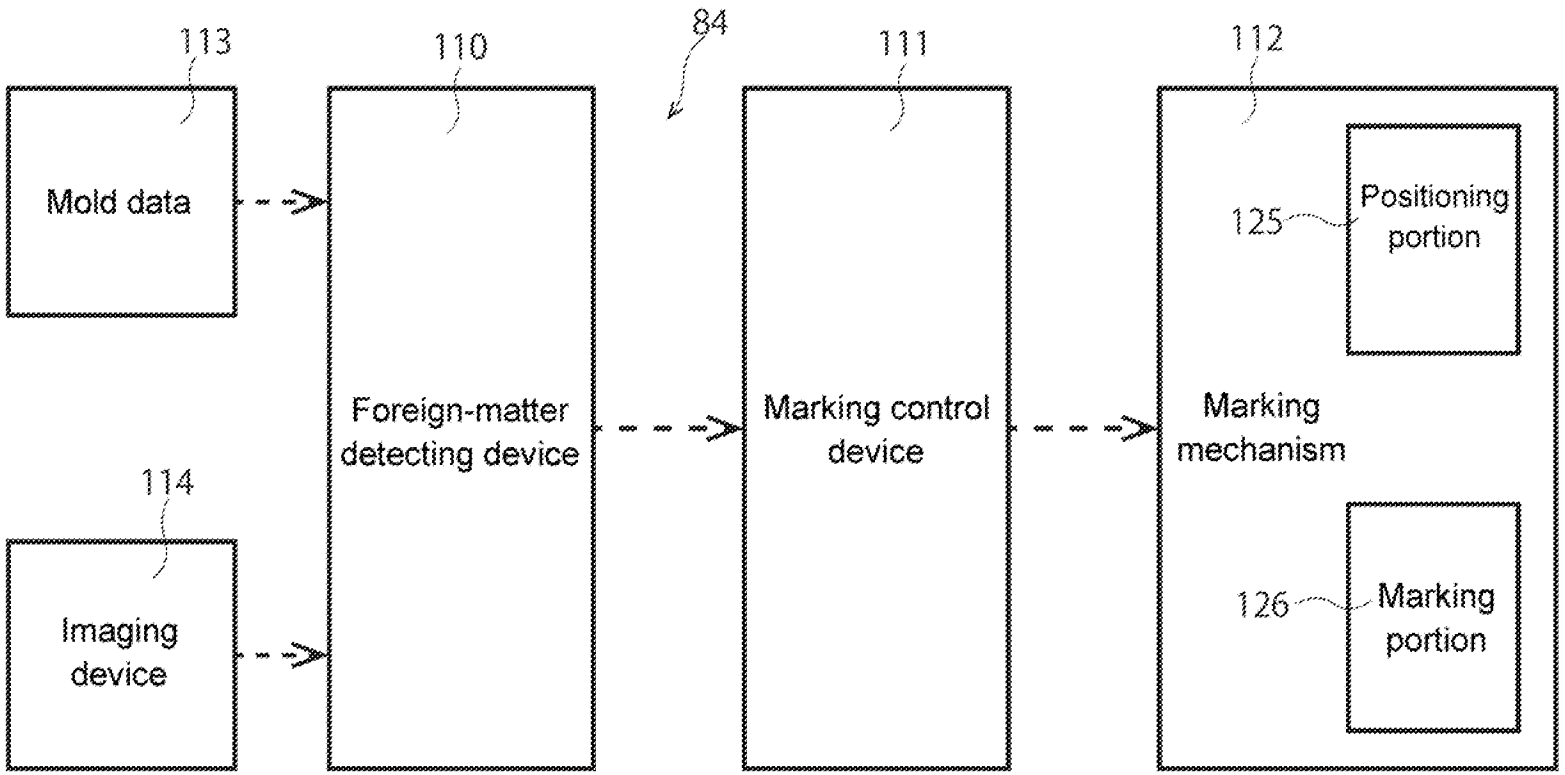
FIG. 3 is a block diagram of the marking device.

FIG. 3 is a block diagram of the marking device 84, which is one embodiment of the present invention.

The marking device 84 comprises a foreign-matter detecting device 110, a marking control device 111, and a marking mechanism 112.

Mold data 113 of a casting and an output of an imaging device 114 are input into the foreign-matter detecting device 110. Mold data 113 of a casting is casting-related data, such as the shape, plan, weight, etc., of the castings 100 illustrated in FIG. 2. A standard marking location has been set in this mold data, that is, at a predetermined position of the shape of the castings 100 that was designed. The imaging device 114 is provided in the marking device 84, and takes an image of the castings 100 conveyed by the casting conveyor 83 and supplies this output to the foreign-matter detecting device 110.

The foreign-matter detecting device 110 detects presence or absence of foreign matter on the standard marking location of the outer surface of the castings 100 by comparing the mold data 113 with the castings 100 that were actually produced.

Figure 4A:
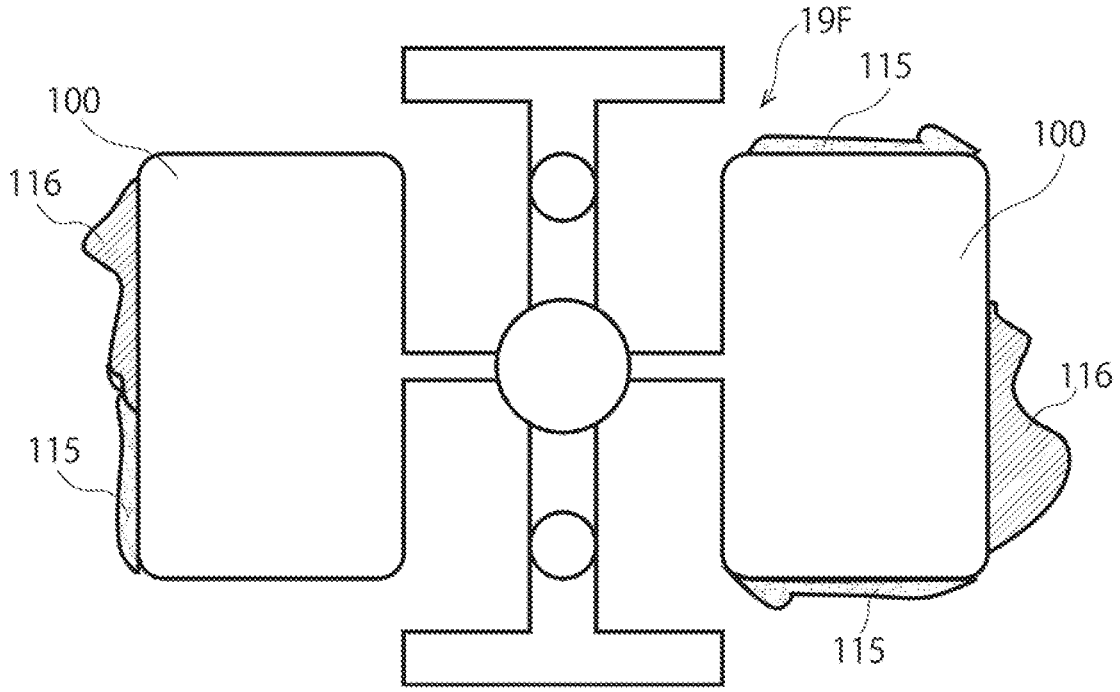
FIG. 4(*a*) is a plan view illustrating castings to be marked to which foreign matter is adhered, and FIG. 4(*b*) is a plan view illustrating an example of a standard marking location and alternative marking locations set for the castings.
Figure 4:
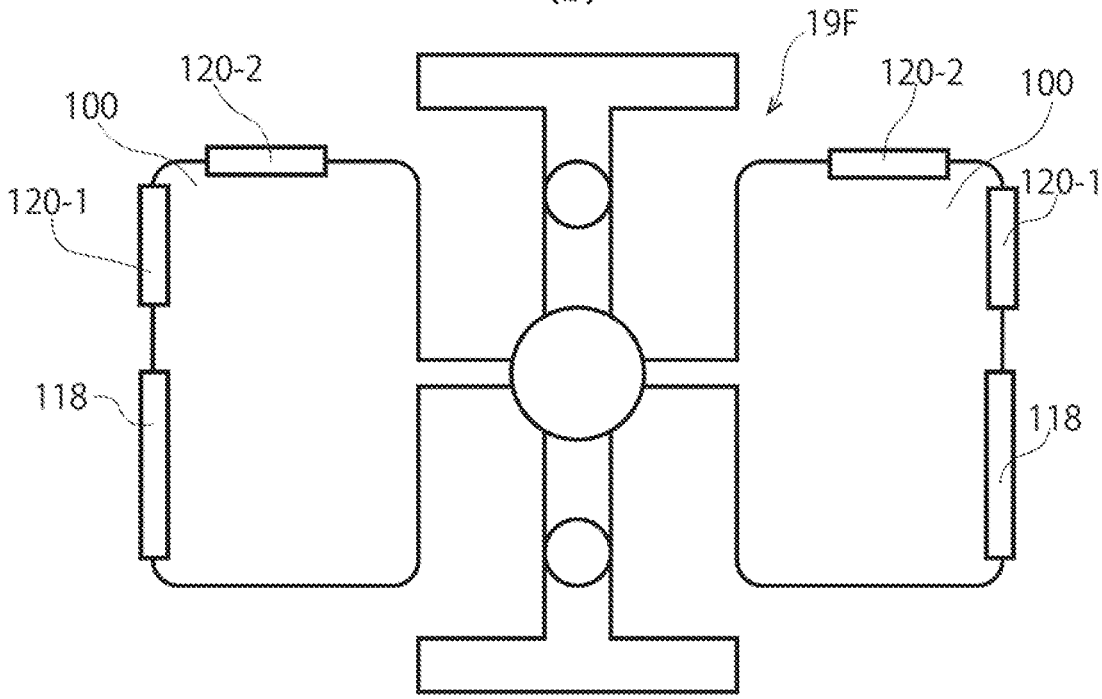

FIG. 4(*a*) illustrates an example in which foreign matter is adhered to the castings 100. In this figure, reference sign 115 is foundry sand adhered to the castings 100, and 116 is a fin formed on the castings 100.

In FIG. 3, an output of the foreign-matter detecting device 110 is sent to the marking control device 111.

The marking control device 111 controls the marking mechanism 112 in response to presence or absence of foreign matter on the castings 100.

The marking control device 111 sets alternative marking locations with priority order thereof when foreign matter is present on the standard marking location of the castings 100.

FIG. 4(*b*) is an example in which alternative marking locations 120-1, 120-2 were set when foreign matter was adhered to the standard marking location 118 of the castings 100.

A plurality of alternative marking locations are set with priority of selection being determined in a manner such as 120-1, 120-2, and so on beforehand. Ultimately, the location free of foreign matter with the highest priority is selected.

The marking control device 111 controls the driving of the marking mechanism 112 so as to make a mark on the standard marking location that was set in the mold data, or set the marking location to an alternative marking location and make a mark on the alternative marking location, in accordance with presence or absence of foreign matter on the castings 100. If foreign matter is detected on all of the alternative marking locations that were set beforehand, this is determined to be a process abnormality and a warning is issued by the marking control device 111.

Figure 5:
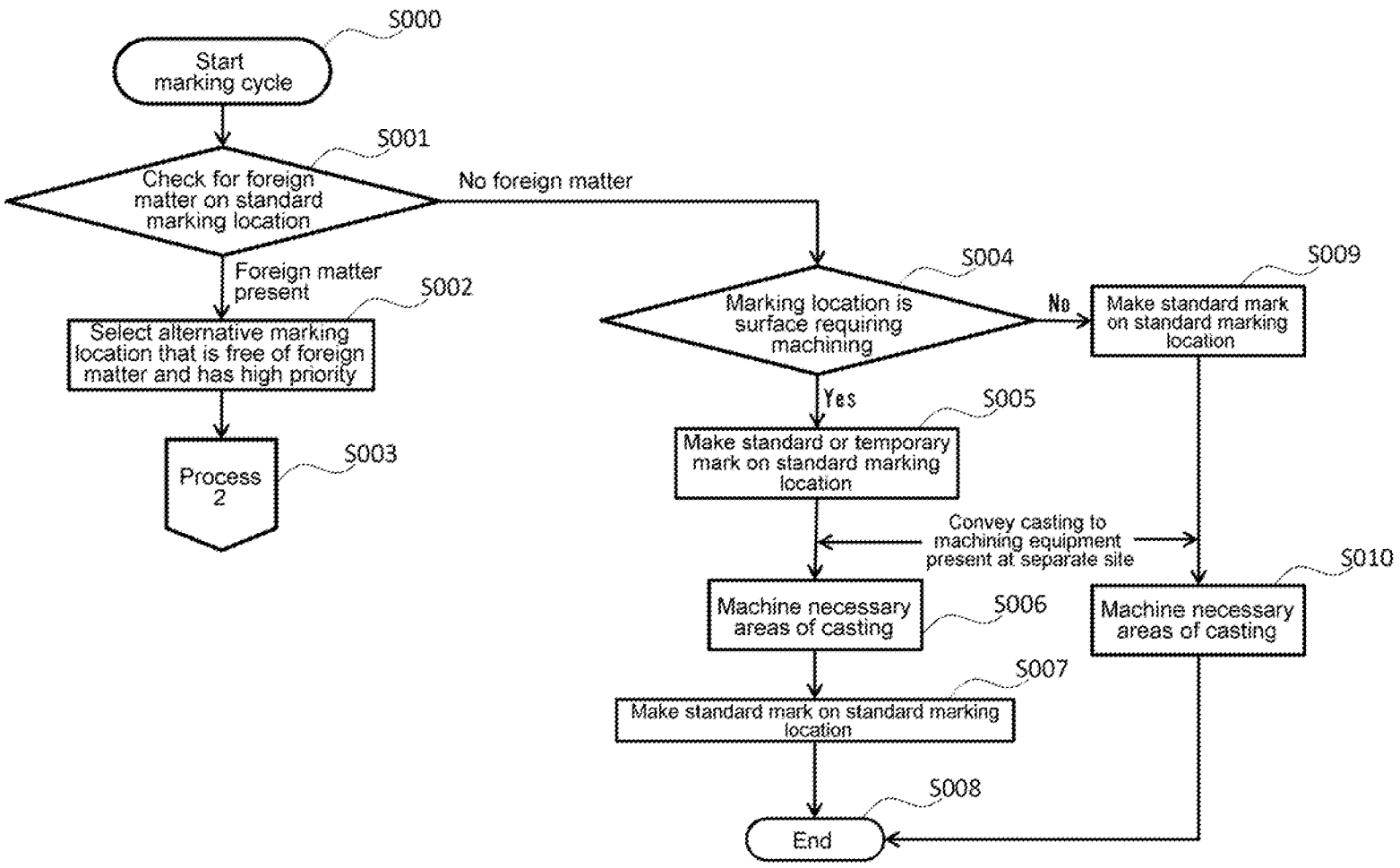
FIG. 5 is a flow chart illustrating control of marking locations and marking for a casting, which is one embodiment of the present invention.
Figure 6:
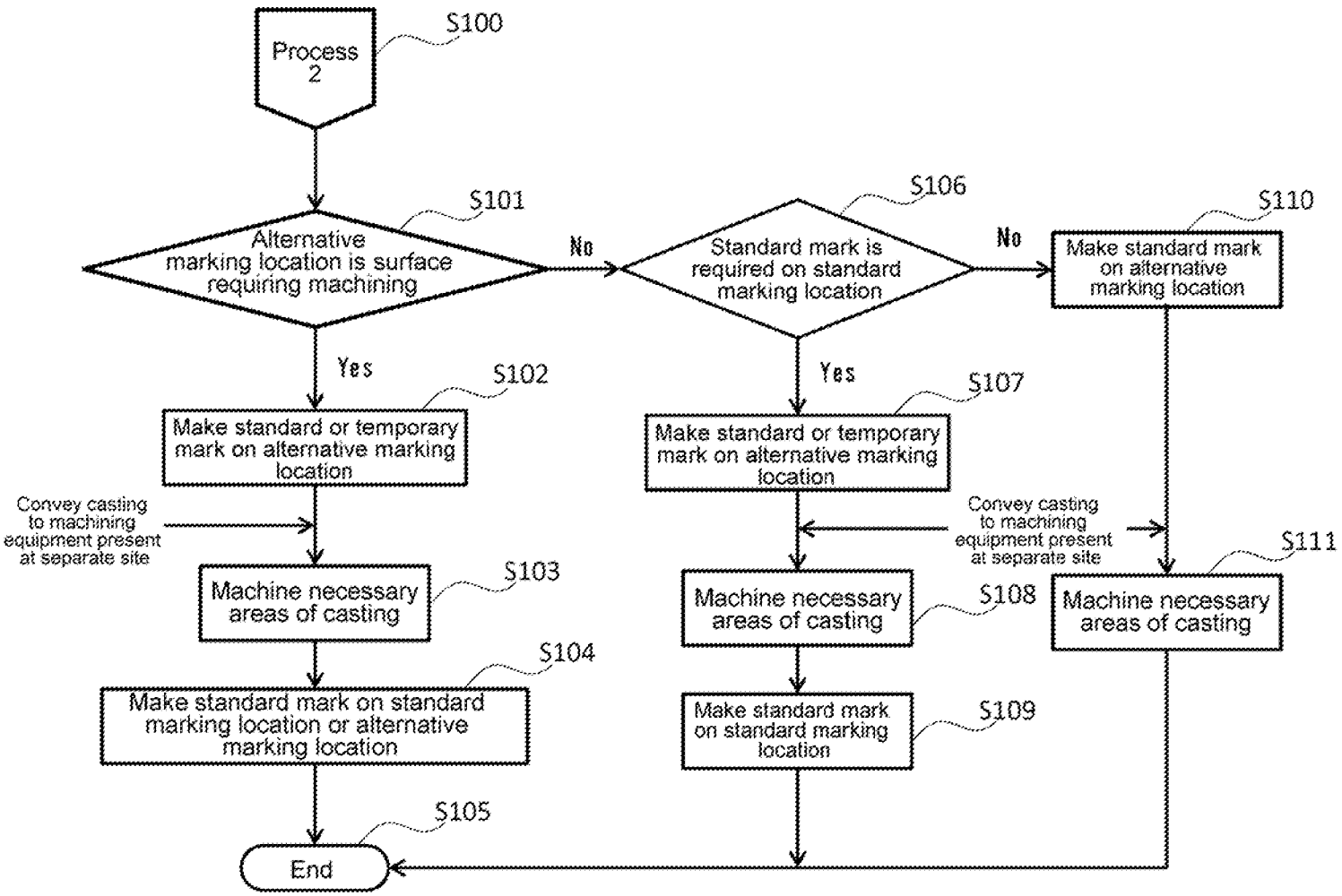
FIG. 6 is a flow chart illustrating control of marking locations and marking for a casting, which is one embodiment of the present invention.

Control of the marking mechanism 112 by means of the marking control device 111 can be implemented by differentiating each kind of marking method by the marking mechanism 112. FIG. 5 and FIG. 6 are flow charts illustrating control of marking locations and marking for a casting, which is one embodiment of the present invention.

An explanation will be provided below with reference to these figures.

In the flow charts shown in FIG. 5 and FIG. 6, S006, S010, S103, S108, and S111 are steps for performing machining. The steps prior to these steps are prior to machining, and those after are after machining.

First, with reference to FIG. 5, the marking cycle starts with S000. The foreign-matter detecting device 110 checks for foreign matter on the standard marking location 118 and sends the result to the marking control device 111 (S001). If the standard marking location 118 is determined to be free of foreign matter, then the marking control device 111 checks whether or not the standard marking location 118 is a face that requires machining (S004). If the standard marking location 118 is not a face that requires machining, then a standard mark is made on the standard marking location 118 by means of the marking mechanism 112 (S009). Next, the castings 100 and gates are separated by the casting-gate separation device 85, the castings 100 are conveyed to the machining equipment 86 present at a separate site, the necessary areas of the castings are machined (S010), and then the cycle ends (S008).

In S004, if the standard marking location 118 is determined to be a face that requires machining, then a standard or temporary mark is made on the standard marking location 118 (S005). Next, the castings 100 and gates are separated by the casting 100-gate separation device 85, the castings 100 are conveyed to the machining equipment 86 present at a separate site, and then the necessary areas of the castings are machined (S006). Then, a standard mark is made on the standard marking location 118 (S007) and the cycle ends (S008). In this case, a mark is made on the same marking location 118 prior to and after machining, and although the mark prior to machining is completely scraped off by machining, mark identification is enabled even if a mark is made again on the same location after machining.

In FIG. 5, S001, if foreign matter is determined to be present on the standard marking location 118, the marking control device 111 selects an alternative marking location that is free of foreign matter and has high priority (S002). Then, a subsequent cycle starts from FIG. 6, S100. The marking control device 111 checks whether or not alternative marking location 120-1 or 120-2 is a face that requires machining (S101). If alternative marking location 120-1 or 120-2 is determined to be a face that requires machining, a standard or temporary mark is made on alternative marking location 120-1 or 120-2 (S102). Next, the castings 100 and gates are separated by the casting 100-gate separation device 85, the castings 100 are conveyed to the machining equipment 86 present at a separate site, and the necessary areas of the castings are machined (S103). Then, a standard mark is made on the standard marking location 118, or alternative location 120-1 or 120-2 (S104), and the cycle ends (S105).

In S101, if alternative marking location 120-1 or 120-2 is determined to not be a face that requires machining, the marking control device 111 checks whether or not a standard mark is required on the standard marking location 118 (S106). If a standard mark is required on the standard marking location 118, a standard or temporary mark is made on alternative marking location 120-1 or 120-2 (S107). Next, the castings 100 and gates are separated by the casting 100-gate separation device 85, the castings 100 are conveyed to the machining equipment 86 present at a separate site, and the necessary areas of the castings are machined (S108). Then, a standard mark is made on the standard marking location 118 (S109) and the cycle ends (S105).

In S106, if a standard mark is not required on the standard marking location 118, a standard mark is made on alternative marking location 120-1 or 120-2 (S110). Next, the castings 100 and gates are separated by the casting 100-gate separation device 85, the castings 100 are conveyed to the machining equipment 86 present at a separate site, the necessary areas of the castings are machined (S111), and then the cycle ends (S105).

The marking mechanism 112 makes a mark on the castings 100 on the basis of an instruction from the marking control device 111.

In this case, the marking mechanism 112 comprises a positioning portion 125 and a marking portion 126, as illustrated in FIG. 3, and based on the instruction from the marking control device 111, the marking portion 126 faces the standard marking location and alternative marking location of the castings 100 by means of the positioning portion 125, and the marking portion 126 makes a predetermined mark.

In each of the steps described above, prior to machining (S006, S010, S103, S108, S111), a mark on an alternative marking location is made as a temporary mark (S102, S107), and after machining, a standard mark is made on the standard marking location of the casting on which the temporary mark was made (S104, S109). The mark made on the alternative marking location prior to the machining can, as a representation method thereof, be simplified by for example using a simple combination of characters.

In the machining described above (S006, S010, S103, S108, S111), when a temporary mark has been made on an alternative marking location, the temporary mark is scraped off, and furthermore, the standard marking location is caused to be in a clean state. Accordingly, it is possible to reliably make a standard mark on the standard marking location for the castings 100, and thus, traceability of the castings 100 is secured.

In addition, regarding the cast product 19F, prior to machining (S006, S010, S103, S108, S111), when a mark on the standard marking location and a mark on an alternative marking location are made as temporary marks (S005, S102, S107), and after the machining, a standard mark is made on the standard marking location (S007, S104, S109), the representation of the marks prior to machining can be simplified by for example using a simple combination of characters.

In the machining described above (S006, S010, S103, S108, S111), when a temporary mark has been made on an alternative marking location, the temporary mark is scraped off, and furthermore, the standard marking location is caused to be in a clean state. Accordingly, in this case as well, it is possible to reliably make a standard mark on the standard marking location for the castings 100, and thus, traceability of the castings 100 is secured.

As explained above, according to the marking device 84, making a mark on the cast product 19F in a manner as described above enables reliable marking without being affected by presence or absence of foreign matter on the cast product 19F, and it is possible to secure traceability of each casting 100. In addition, by making a temporary mark, which serves as a visible indication, on an alternative location if for example foreign matter was detected, it is possible to reduce the working time for marking compared to the application of marks containing large amounts of data, such as QR Codes®, and marks can efficiently be made.

In addition, regarding each casting 100 sequentially produced by the casting equipment 1, by configuring such that a failure countermeasure signal of the casting equipment 1 is issued when inspection for foreign matter is performed by means of the foreign-matter detecting device 110 of the marking device 84 and the number of detections of foreign matter exceeds a certain number or a certain ratio, it is possible to quickly take countermeasures against problems such as fins, remaining sand, and burn-ons on the surface of castings.

As explained above, because the marking device 84 comprises a foreign-matter detecting device 110, a marking control device 111, and a marking mechanism 112, it is possible to implement, as a marking method for a casting that makes a mark on a casting 100, a method comprising detecting foreign matter on an outer surface of the casting 100, and setting a marking location in response to presence or absence of foreign matter and making a mark on the marking location.

Thus, in the marking device 84 and marking method described above, even when foreign matter is adhered to a casting 100 to be marked, it is possible to make an effective and appropriate mark on the casting 100.

In addition, by making an effective and appropriate mark on a casting 100, it is possible for information on production conditions up until the end of machining of a cast product 19F to be associated with the cast product 19F. Thus, it is possible to secure reliable traceability of each casting 100.

Note that in the marking device 84 described above, the imaging device 114 can select various kinds of shape-imaging devices, such as an in-line profile measuring instrument. In addition, in the embodiment described above, control of marking locations and marking was performed for castings 100, but the control can also be performed for the entirety of the cast product 19F, including the castings 100 and other parts of the cast product 19F.

In addition, in the embodiment described above, an explanation was provided regarding a case in which the cast product 19F has a plurality of castings 100, but in the present invention, the number of castings 100 may be one, and the present invention can be applied to a cast product that has been provided with one or more castings.

REFERENCE SIGNS LIST

1 Casting equipment
100 Casting
101, 103 Coupling portion
110 Foreign-matter detecting device
111 Marking control device
112 Marking mechanism
113 Mold data
118 Standard marking location
120-1, 120-2 Alternative marking location
19F Cast product
84 Marking device

The invention claimed is:

1. A marking method for a casting that makes a mark on the casting, the marking method comprising:
   - detecting foreign matter on an outer surface of the casting;
   - setting a marking location and making the mark on the marking location, wherein the marking location includes a standard marking location and an alternative marking location;
   - detecting presence or absence of foreign matter for the standard marking location of the casting by comparing mold data of the casting with the casting; and
   - making the mark on the standard marking location or the alternative marking location.

2. The marking method for the casting according to claim 1, comprising making the mark on the alternative marking location when foreign matter is detected on the standard marking location.

3. The marking method for the casting according to claim 2, wherein a cast product is configured to comprise one or more of the castings; and for the cast product, prior to machining, a mark on the alternative location is made as a temporary mark; and after the machining, a standard mark is made on the standard marking location of the casting on which the temporary mark was made.

4. The marking method for the casting according to claim 3, comprising inspecting for the foreign matter for each casting sequentially produced by casting equipment, and issuing a failure countermeasure signal of the casting equipment when a number of detections of the foreign matter exceeds a certain number of times or a certain ratio.

5. The marking method for the casting according to claim 2, wherein a cast product is configured to comprise one or more of the castings; and for the cast product, prior to machining, a mark on the standard marking location and a mark on the alternative marking location are made as temporary marks; and after the machining, a standard mark is made on the standard marking location.

6. The marking method for the casting according to claim 5, comprising inspecting for the foreign matter for each casting sequentially produced by casting equipment, and issuing a failure countermeasure signal of the casting equipment when a number of detections of the foreign matter exceeds a certain number of times or a certain ratio.

7. The marking method for the casting according to claim 2, comprising inspecting for the foreign matter for each casting sequentially produced by casting equipment, and issuing a failure countermeasure signal of the casting equipment when a number of detections of the foreign matter exceeds a certain number of times or a certain ratio.

8. The marking method for the casting according to claim 1, wherein a cast product is configured to comprise one or more of the castings; and for the cast product, prior to machining, a mark on the alternative location is made as a temporary mark; and after the machining, a standard mark is made on the standard marking location of the casting on which the temporary mark was made.

9. The marking method for the casting according to claim 8, comprising inspecting for the foreign matter for each casting sequentially produced by casting equipment, and issuing a failure countermeasure signal of the casting equipment when a number of detections of the foreign matter exceeds a certain number of times or a certain ratio.

10. The marking method for the casting according to claim 1, wherein a cast product is configured to comprise one or more of the castings; and for the cast product, prior to machining, a mark on the standard marking location and a mark on the alternative marking location are made as temporary marks; and after the machining, a standard mark is made on the standard marking location.

11. The marking method for the casting according to claim 10, comprising inspecting for the foreign matter for each casting sequentially produced by casting equipment, and issuing a failure countermeasure signal of the casting equipment when a number of detections of the foreign matter exceeds a certain number of times or a certain ratio.

12. The marking method for the casting according to claim 1, comprising inspecting for the foreign matter for each casting sequentially produced by casting equipment, and issuing a failure countermeasure signal of the casting equipment when a number of detections of the foreign matter exceeds a certain number of times or a certain ratio.

* * * * *